United States Patent [19]

Lucke

[11] Patent Number: 4,991,336

[45] Date of Patent: Feb. 12, 1991

[54] PHOTOGRAPHIC COMPOSITE BOARD

[76] Inventor: Robert D. Lucke, 210 S. Mulnix St., Kirksville, Mo. 63501

[21] Appl. No.: 378,300

[22] Filed: Jul. 11, 1989

[51] Int. Cl.[5] ..... G09F 3/10

[52] U.S. Cl. ..... 40/630; 40/158.1; 40/626; 428/13; 428/138

[58] Field of Search ..... 40/630, 158.1, 625, 40/626, 152, 152.1, 155, 615; 428/13, 138; D6/301

[56] References Cited

U.S. PATENT DOCUMENTS

| | | | |
|---|---|---|---|
| 1,906,555 | 5/1933 | Donnell | D6/301 |
| 2,218,409 | 10/1940 | Smalls | 40/152 |
| 2,256,399 | 9/1941 | MacHarg | 40/152 |
| 2,268,529 | 12/1941 | Stiles | 40/152 |
| 2,586,009 | 2/1952 | Dickey | 40/158.1 |
| 2,867,053 | 1/1959 | Boor | 428/13 |
| 3,873,405 | 3/1975 | Wilkes | 40/158.1 |
| 4,019,943 | 4/1977 | Holson | 40/158.1 |
| 4,059,912 | 11/1977 | Noah | 40/630 |
| 4,400,419 | 8/1983 | Laczynski | 428/189 |
| 4,424,637 | 1/1984 | Leahy | 40/152 |
| 4,790,563 | 12/1988 | Instance | 40/306 |
| 4,794,716 | 1/1989 | George et al. | 40/158.1 |

FOREIGN PATENT DOCUMENTS

| | | | |
|---|---|---|---|
| 237061 | 1/1881 | United Kingdom | 40/158.1 |

*Primary Examiner*—Kenneth J. Dorner
*Assistant Examiner*—Brian K. Green
*Attorney, Agent, or Firm*—Nicholas J. Aquilino

[57] ABSTRACT

A photographic composite laminate board for mounting graphic material such as a series of photographs and descriptive graphic material. The board is formed with a transparent cover, a masking layer having openings for the graphics and a thin plastic backing sheet covering the graphics and the masking layer.

7 Claims, 1 Drawing Sheet

PHOTOGRAPHIC COMPOSITE BOARD

BACKGROUND OF THE INVENTION

The present invention deals with photographic composite boards, and in particular with a novel method of production and composite laminate structure of photographic composite boards.

Current photographic composite boards are often large and heavy made with rigid materials making it difficult to handle and cumbersome to store when it is not being used. Examples of such composite boards use photgraphs which are pasted, or otherwise adhered, to a pressed fiber board. Various methods of lettering currently used are time consuming. Often the photographic composite boards are unprotected making them susceptible to soiling, discoloration and other damage.

Prior art photographic composite structures are shown, for example, in the patent to Edwards (2,084,579) in which a plurality of pictures are mounted on an album leaf formed of separate sheets which are pasted together. The upper sheet includes spaced pockets or envelopes on the innerface to receive the photographs. The patent to Power (2,936,540) shows another composite board including a back plate, graphics and a series of open areas for the insertion of photographic inserts as well as descriptive material.

Still another patent of interest is shown to Leahy (4,424,637) to a gallery picture frame for securing a plurality of photographs including a mounting panel having an adhesive coated back sheet which removably secures the snapshots to the mounting panel. A frame is provided which may include additional panels for borders around each photograph. The patent to Muzik (4,125,653) shows a graphic photographic laminate which is mounted on a thick mounting base of rigid translucent material and includes a layer of plastic material having pressure-sensitive adhesive coating on both surfaces for permanently bonding the layers. Other prior art patents showing similar structures are those to Lieberman (4,231,833). Lacztyski (4,400,419) and Helinski (4,666,757).

The present invention provides a photographic composite laminated board which is flexible and lightweight which may be rolled up and stored in a storage tube, or displayed in a frame. The laminate structure is formed with lightweight plastic materials which form a laminate structure around the photographs and other suitable decorative or illustative material. The laminate includes a base, or cover member, of transparent plastic having a highly polished back surface and a velvet non-glare front surface, graphics and/or lettering, a masking layer including clear windows forming openings for photographs and descriptive or other graphic material, and a back sheet layer of plastic.

To produce the composite photographic board, the front of the board forms the base layer with the velvet, non-glare surface to the outside. Suitable graphics made photographically are added to the base layer with a film acetate, back coated with pressure-sensitive adhesive. A masking layer is added having clear windows for pictures and descriptive material. The pictures and respective name plates or other descriptive material is added. The composite board is completed by a layer of 4 mil. thick vinyl.

Among the objects of the present invention are the provision of a photographic composite board which is lightweight, flexible and which is easy to mount and store in either a flat or rolled condition; the provision of a composite photographic board which is simple to create with readily avaliable and inexpensive materials and equipment.

DESCRIPTION OF PREFERRED EMBODIMENTS

Figure 2:
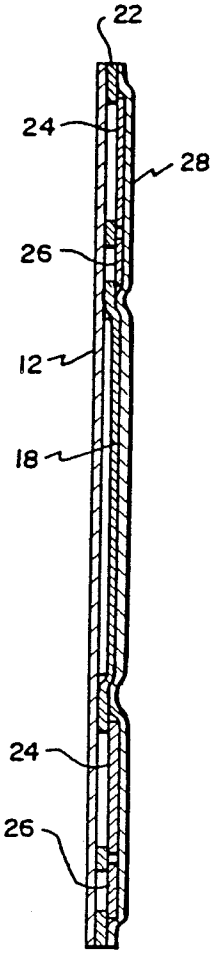
FIG. 2 is a sectional view taken along the lines 2—2 of FIG. 1.
Figure 1:
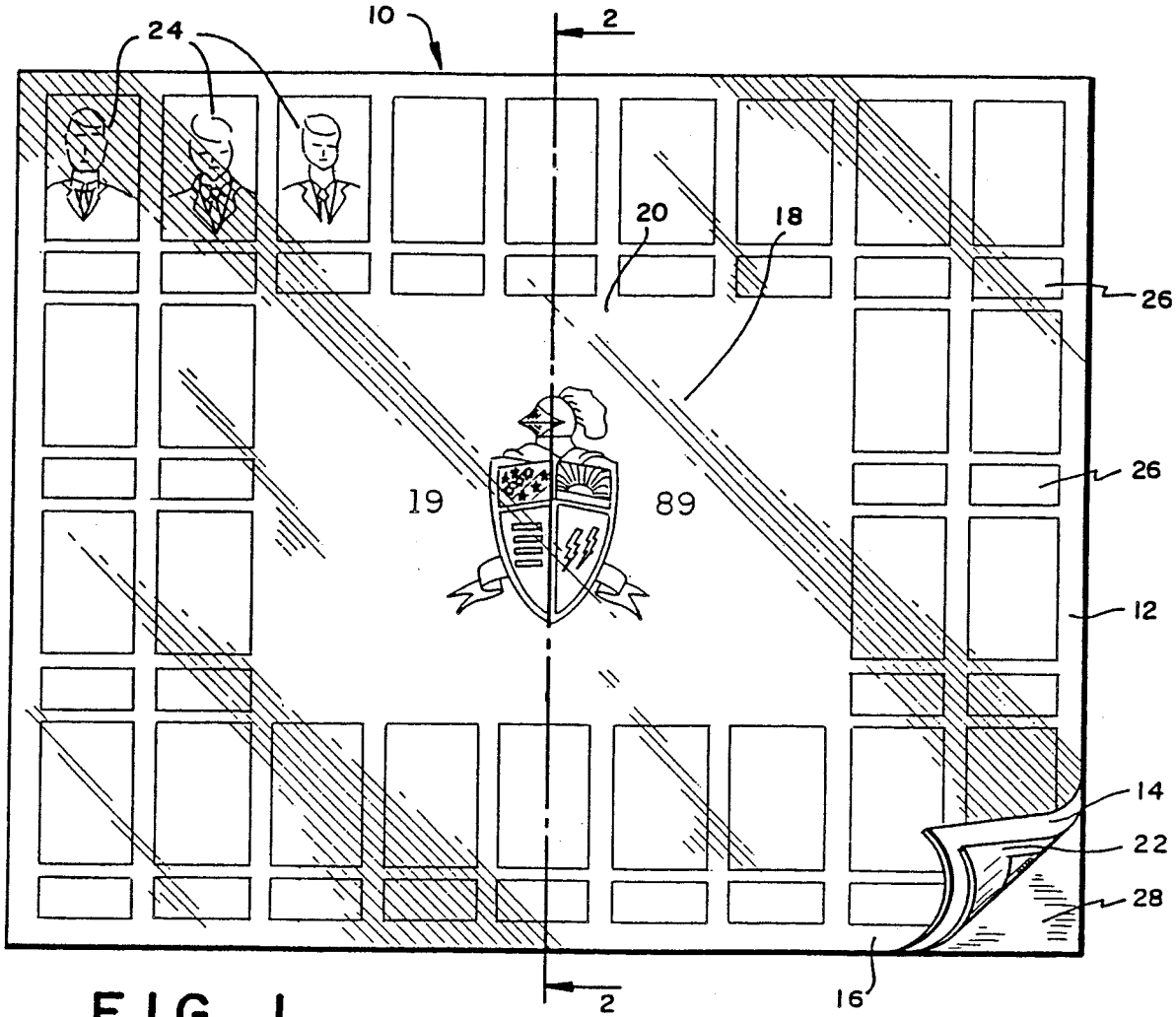
FIG. 1 is a pictorial view of a photographic composite board of the present invention.

Referring to the drawings, the flexible photographic composite board 10 for displaying graphic material, includes a base or cover layer 12 formed of 0.015 gauge transparent plastic having the characteristics of a highly polished inner surface 14 and a velvet non-glare outer surface 16. In the embodiment shown, the photographic composite board 10 represents a series of photographs of students in a school. To identify and add to the aesthetic and decorative features of the board, various decorations and/or graphic descriptions may be provided. For example, a crest 18, which consists of a positive transparent film image made photographically from an original work of art, is included and is attached directly to the inner surface cover layer 12. The crest 18 is preferably made on a film acetate which is back coated with pressure-sensitive material. The composite board 10 includes lettering or other graphics 20 which, in the embodiment shown, are added to the crest area. The letters are also made from pressure-sensitive casted vinyl, and can be made by cutting them in reverse and adhering them directly to the polished inner surface 14 of the base layer 12. The composite board 10 is provided with a masking layer 22 substantially coextensive with the cover layer 12 and having a pressure-sensitive adhesive on one side thereof which is placed over the crest 18 and lettering 20 in interfacial contact with and adhered to the cover layer 12. The masking layer 22 includes clear windows for a series of pictures 24 and name plates 26. The pictures 24 and their respective name plates 26 are placed in the windows and may be temporarily affixed prior to the final laminating step.

The complete composite board is completed using a 4 mil. calendered vinyl backing sheet 28 having pressure-sensitive adhesive placed over the photographs and other graphic material and which is coextensive with the peripheral edges of the cover layer 12.

It will be appreciated that the composite board formed in accordance with the present invention is lightweight and thin, being no more than approximately 20 to 30 mm. in thickness. The transparent plastic surface and vinyl back sheet provide an extremely durable and damage-resistent product which is easily stored in a rolled or flat condition and which can be mounted either directly upon a wall or in a frame.

It will be appreciated that whereas the invention is described in detail, that alterations can be made in keeping with the invention as defined by the following claims.

I claim:

1. A composite board for mounting and displaying photographic and graphic articles comprising:

a cover layer of transparent plastic material having a non-glare outer surface and a highly polished inner surface;

a layer formed of at least one sheet of graphic material in interfacial contact with said cover layer and having an adhesive for bonding said graphic material to said inner surface of said cover layer;

a masking layer having a pressure sensitive adhesive on one layer thereof and in interfacial contact with and permanently bonded to said graphic material layer and to said inner surface of said cover layer, said masking layer being further defined by at least one opening therein;

at least one photograph in alignment with said one opening in said masking layer; and a flexible plastic backing sheet having a pressure sensitive adhesive on an inner surface thereof in interfacial contact with said masking layer and said photograph and permanently bonded thereto, thereby laminating said photograph and said graphic material between said cover layer and said cover layer and said backing layer.

2. The photograph composite laminate board of claim 1 wherein said backing sheet is vinyl.

3. The photographic composes laminate board of claim 2 wherein said vinyl sheet is 4 mil. in thickness.

4. The photographic composite laminate board of claim 1 wherein the total thickness of the board does not exceed 30 mils.

5. The composite laminate board of claim 1 wherein said masking layer is characterized by a plurality of openings and further including a plurality of photographs in alignment with each of said openings.

6. The composite laminate of board of claim 5 further including descriptive graphic material associated with each of said plurality of photographs and wherein said masking layer includes another group of a plurality of openings for said descriptive material.

7. A flexible composite laminate board for mounting and displaying photographic and graphic articles comprising:

a cover layer of transparent plastic material having a non-glare outer surface and a highly polished inner surface;

a layer of graphics formed of at least one sheet of graphic material in interfacial contact and bonded to a portion of said inner surface of said cover layer;

a masking layer co-extensive with said cover layer and having a pressure sensitive adhesive on one side thereof said side being in interfacial contact with and permanently bonded to said sheet of graphic material and said inner surface of said cover layer;

said masking layer being further defined by a plurality of openings;

a plurality of photographs in alignment with each of said openings in said masking layer and being positioned in said openings so as to be in interfacial contact with said inner surface of said inner layer; and a flexible, plastic backing sheet having a pressure sensitive adhesive on one surface thereof so as to be in interfacial contact with and bonded to said masking layer and said photographs forming a flexible composite laminate board having a total thickness not to exceed 30 mils.

* * * * *